US008162772B1

(12) United States Patent
Galloway

(10) Patent No.: US 8,162,772 B1
(45) **Date of Patent: *Apr. 24, 2012**

(54) DEVICE TO MEASURE THE MOTION OF A GOLF CLUB

(75) Inventor: J. Andrew Galloway, Escondido, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/298,041

(22) Filed: Nov. 16, 2011

Related U.S. Application Data

(63) Continuation of application No. 13/030,910, filed on Feb. 18, 2011, now Pat. No. 8,062,145, which is a continuation-in-part of application No. 12/790,372, filed on May 28, 2010, now Pat. No. 7,892,102.

(60) Provisional application No. 61/184,199, filed on Jun. 4, 2009.

(51) Int. Cl.
*A63B 69/36* (2006.01)

(52) U.S. Cl. ..... 473/225; 473/219; 473/222

(58) Field of Classification Search ..... 473/150, 473/151, 219, 221, 222, 223, 225, 226, 257, 473/407, 409
See application file for complete search history.

(56) References Cited

U.S. PATENT DOCUMENTS

| | | | | |
|---|---|---|---|---|
| 4,254,956 | A * | 3/1981 | Rusnak | 473/225 |
| 4,615,526 | A * | 10/1986 | Yasuda et al. | 473/222 |
| 5,114,450 | A * | 5/1992 | Paradowski et al. | 62/625 |
| 5,474,298 | A * | 12/1995 | Lindsay | 473/222 |
| 5,826,874 | A * | 10/1998 | Teitell et al. | 473/225 |
| 6,437,559 | B1 * | 8/2002 | Zajac et al. | 324/179 |
| 7,892,102 | B1 * | 2/2011 | Galloway | 473/225 |
| 8,062,145 | B1 * | 11/2011 | Galloway | 473/225 |
| 2003/0054898 | A1 * | 3/2003 | Otten et al. | 473/219 |

* cited by examiner

*Primary Examiner* — Nini Legesse
(74) *Attorney, Agent, or Firm* — Michael A. Catania; Rebecca Hanovice; Sonia Lari

(57) ABSTRACT

A club shaft that can be installed in a club head permanently or can be installed in clubs with interchangeable shaft features is disclosed herein. The invention is a measurement system that enables the capturing of the speed and motion of the golfer's swing. The invention uses magnetic material positioned on a face of a golf club head and an array of magnetic sensors.

3 Claims, 1 Drawing Sheet

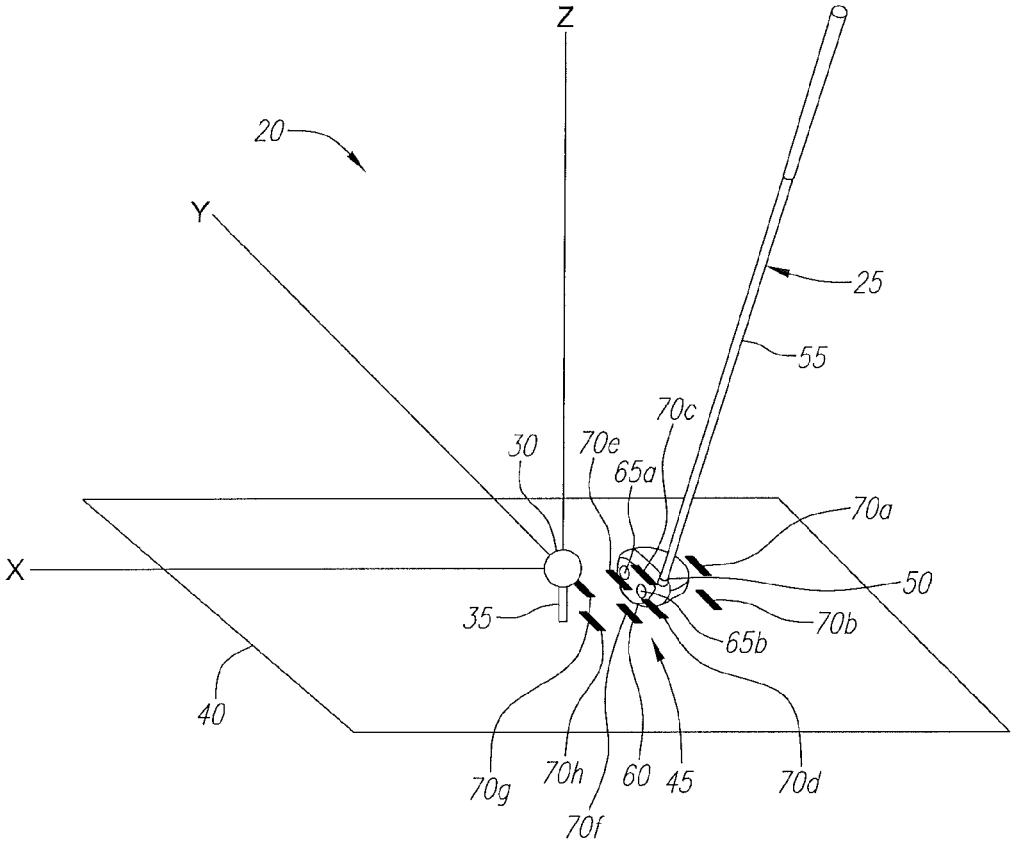
Z
20
Y
25
55
70c
30
70e
65a
70a
X
50
35
70b
65b
40
70g
70h
60
45
70d
70f

DEVICE TO MEASURE THE MOTION OF A GOLF CLUB

CROSS REFERENCES TO RELATED APPLICATIONS

The present application is a continuation application of U.S. patent application Ser. No. 13/030,910, filed on Feb. 18, 2011, which is a continuation-in-part application of U.S. patent application Ser. No. 12/790,372, filed on May 28, 2010, now U.S. Pat. No. 7,892,192, which claims priority to U.S. Patent Application No. 61/184,199, filed on Jun. 4, 2009, now abandoned, all of which are hereby incorporated by reference in their entireties.

STATEMENT REGARDING FEDERALLY SPONSORED RESEARCH OR DEVELOPMENT

Not Applicable

BACKGROUND OF THE INVENTION

1. Field of the Invention

The present invention relates to a swing analysis devices for golf clubs. More specifically, the present invention relates to a golf club swing analysis device that uses magnetism.

2. Description of the Related Art

Golf clubs combine with the players swing to propel a ball toward a favored location and through a favored path. The orientation and speed of the club head at impact largely determines the ball path including carry distance and roll.

The prior art is lacking in a method and system to measure the motion of the club using magnetism.

BRIEF SUMMARY OF THE INVENTION

The present invention is novel in that the observation of the relative motion does not depend on near visible light and uses a coherent pattern to capture the position of the club relative the ground antenna transmitter/receiver. This fixed device also includes a display, computing capability and recording device. This information, when processed, enables the display of the swing and uses data on the club head and ball to calculate the flight of the ball.

This invention is a club that uses ferro-magnetic dots or strips that can be attached to a face of a golf club head. The club is swung through an array of magnetic sensors positioned on a surface, preferably in front of a golf ball, to capture the speed and motion of the golfer's swing. The system is designed to improve the accuracy of measurement of location as a function of time. The invention enables the accurate measurement and capture of the swing, produces a display of the impact and ball flight and thus improves the training and practice results for the golfer.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 1 is a perspective view of system for measuring the motion of a club through a magnetic sensor field.

DETAILED DESCRIPTION OF THE INVENTION

As shown in FIG. 1, a golf club bearing light-weight strips or dots of a ferro-magnetic material on a face of a golf club head is swung through an array of magnetic sensors at a golf ball. A system 20 preferably includes a golf club 25, a golf ball 30, a tee 35, a mat 40 and array of magnetic sensors 45. The array of magnetic sensors 45 preferably comprises a plurality of magnetic sensors 70*a-h* arranged in two parallel rows behind the golf ball 30. The golf club 25 includes a shaft 55 and a golf club head 60 with a face 50 having a toe-side magnetic strip or dot 65*a* and a heel-side magnetic strip or dot 65*b*.

In a preferred embodiment, neodymium types of magnets are preferred for the golf application to extend the range. For extended length linear position sensing, multiple sensor bridges are lined up next to a traveling magnet sliding past the bridges. For best resolution and linearity, the +/−45° range is reduced to +/−30 degrees. This system captures the movement of the golf club through the field. Two magnets and two sensors are suggested to characterize the impact and motions. A speed of each magnetic or ferro magnetic piece is the main phenomenon measured by the system. The system shows the motion of the golf club as the speed data, and describes orientation of the golf club over time. The absolute starting point is preferably assumed to be the tee location, but this is assumed relative to the golf club head at address before the swing. Using magnetic fields provide orientation of the magnet which is oriented to the golf club or golf club head. Multiple magnets improve the accuracy and reliability. A tracking system placed adjacent to the impact location measures the speed and magnetic orientation changes.

The following patents disclose various golf clubs that may be used with the device of the present invention. Gibbs, et al., U.S. Pat. No. 7,163,468 is hereby incorporated by reference in its entirety. Galloway, et al., U.S. Pat. No. 7,163,470 is hereby incorporated by reference in its entirety. Williams, et al., U.S. Pat. No. 7,166,038 is hereby incorporated by reference in its entirety. Desmukh U.S. Pat. No. 7,214,143 is hereby incorporated by reference in its entirety. Murphy, et al., U.S. Pat. No. 7,252,600 is hereby incorporated by reference in its entirety. Gibbs, et al., U.S. Pat. No. 7,258,626 is hereby incorporated by reference in its entirety. Galloway, et al., U.S. Pat. No. 7,258,631 is hereby incorporated by reference in its entirety. Evans, et al., U.S. Pat. No. 7,273,419 is hereby incorporated by reference in its entirety. Hocknell, et al., U.S. Pat. No. 7,413,250 is hereby incorporated by reference in its entirety.

The measurements may be inputted into an impact code such as the rigid body code disclosed in U.S. Pat. No. 6,821,209, entitled Method for Predicting a Golfer's Ball Striking Performance, which is hereby incorporated by reference in its entirety.

The swing properties are preferably determined using an acquisition system such as disclosed in U.S. Pat. No. 6,431,990, entitled System and Method for Measuring a Golfer's Ball Striking Parameters, assigned to Callaway Golf Company, the assignee of the present application, and hereby incorporated by reference in its entirety. However, those skilled in the pertinent art will recognize that other acquisition systems may be used to determine the swing properties.

Other methods that are useful in obtaining a golfer's swing characteristics are disclosed in U.S. Pat. No. 6,638,175, for a Diagnostic Golf Club System, U.S. Pat. No. 6,402,634, for an Instrumented Golf Club System And Method Of Use, and U.S. Pat. No. 6,224,493, for an Instrumented Golf Club System And Method Of Use, all of which are assigned to Callaway Golf Company, the assignee of the present application, and all of which are hereby incorporated by reference in their entireties.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention the following:

1. A system for measuring the motion and speed of a golf club swung by a golfer, the system comprising:

a golf club comprising a shaft and a golf club head, the golf club head having two strips of a magnetic material thereon, a first strip of the magnetic material positioned on a heel-side of a face of the golf club head and a second strip magnetic material positioned on a toe-side of the face of the golf club head; and eight magnetic sensors positioned to create a swing field for reception of a magnetic field from the two strips as the golf club is swung through the swing field towards, the eight magnetic sensors positioned in a pattern below the swing path of the golf club in two rows with each row parallel to the other row and each row having four magnetic sensors;

wherein the eight magnetic sensors capture the speed and motion of the golf club as the golf club is swung through the swing field by a golfer.

2. A system for measuring the motion and speed of a golf club swung by a golfer, the system comprising:

a golf club comprising a shaft and a golf club head, the golf club head having two dots of a magnetic material thereon, a first dot of the magnetic material positioned on a heel-side of a face of the golf club head and a second dot of the magnetic material positioned on a toe-side of the face of the golf club head; and eight magnetic sensors positioned behind a tee position to create a swing field for reception of a magnetic field from the two dots as the golf club is swung through the swing field towards the golf ball, the eight magnetic sensors positioned in a pattern below the swing path of the golf club in two rows with each row parallel to the other row and each row having four magnetic sensors;

wherein the eight magnetic sensors capture the speed and motion of the golf club as the golf club is swung through the swing field by a golfer.

3. A system for measuring the motion and speed of a golf club swung by a golfer, the system comprising:

a golf club comprising a shaft and a golf club head, the golf club head having two strips of a ferro-magnetic material thereon, a first strip of the ferro-magnetic material positioned on a heel-side of a face of the golf club head and a second strip of the ferro-magnetic material positioned on a toe-side of the face of the golf club head; and eight magnetic sensors positioned to create a swing field for reception of a magnetic field from the two strips as the golf club is swung through the swing field towards, the eight magnetic sensors positioned in a pattern below the swing path of the golf club in two rows with each row parallel to the other row and each row having four magnetic sensors;

wherein the eight magnetic sensors to capture the speed and motion of the golf club as the golf club is swung through the swing field by a golfer.

* * * * *